US007350967B2

(12) United States Patent
Jujo

(10) Patent No.: US 7,350,967 B2
(45) Date of Patent: Apr. 1, 2008

(54) SPEED CONTROL MECHANISM AND MECHANICAL TIMEPIECE HAVING THE SAME

(75) Inventor: Koichiro Jujo, Chiba (JP)

(73) Assignee: Seiko Instruments Inc. (JP)

( * ) Notice: Subject to any disclaimer, the term of this patent is extended or adjusted under 35 U.S.C. 154(b) by 40 days.

(21) Appl. No.: 11/360,212

(22) Filed: Feb. 23, 2006

(65) Prior Publication Data

US 2006/0187763 A1 Aug. 24, 2006

(30) Foreign Application Priority Data

Feb. 24, 2005 (JP) ..... 2005-048260

(51) Int. Cl.
*G04B 15/00* (2006.01)

(52) U.S. Cl. ..... 368/175; 368/127

(58) Field of Classification Search ..... 368/127–133, 368/175–178, 184
See application file for complete search history.

(56) References Cited

U.S. PATENT DOCUMENTS 6,554,468 B1 * 4/2003 Manaka et al. ..... 368/127
2002/0167865 A1 * 11/2002 Tokoro et al. ..... 368/175

* cited by examiner

*Primary Examiner*—Gary F. Paumen
(74) *Attorney, Agent, or Firm*—Adam & Wilks

(57) ABSTRACT

A speed control mechanism has a balance with hairspring mounted to undergo oscillation movement and a regulator structure for adjusting a position of the balance with hairspring. The regulator structure is formed of a nonmagnetic material to prevent reduction of an oscillation angle of the balance with hairspring during oscillation movement thereof.

18 Claims, 5 Drawing Sheets

FIG.5A sample

| sample | regulator member | regulator tail portion | finely moving lever | stud bridge | stud | |
|---|---|---|---|---|---|---|
| 1 | carbon steel | carbon steel | carbon steel | brass | brass | comparative example |
| 2 | brass | carbon steel | carbon steel | brass | brass | comparative example |
| 3 | carbon steel | brass | carbon steel | brass | brass | comparative example |
| 4 | brass | brass | carbon steel | brass | brass | embodiment |
| 5 | brass | brass | brass | brass | brass | embodiment |

FIG.5B oscillating angle (unit: degree)

| sample | experiment 1 | experiment 2 | experiment 3 | |
|---|---|---|---|---|
| 1 | -63 | -52 | -65 | comparative example |
| 2 | -59 | -54 | -43 | comparative example |
| 3 | -47 | -39 | -50 | comparative example |
| 4 | -6 | -9 | -10 | embodiment |
| 5 | 8 | -4 | -4 | embodiment |

SPEED CONTROL MECHANISM AND MECHANICAL TIMEPIECE HAVING THE SAME

BACKGROUND OF THE INVENTION

1. Field of the Invention

The present invention relates to a speed control mechanism and a mechanical timepiece having the same.

2. Description of the Prior Art

In a speed control mechanism of a mechanical timepiece, when a balance with hairspring is constituted by a balance stem and accessories thereof (hairspring, hairspring bead, oscillating seat and the like) and a balance wheel, the speed control mechanism of the mechanical timepiece includes a balance with hairspring, a hairspring, a stud structure and a regulator structure. The hairspring in a mode of a spiral spring is fixed to the hairspring bead press-fitted to the balance stem at an inner side end portion in a radius direction thereof, fixed to the stud at an outer side end portion in the radius direction, and an effective length thereof is adjusted by a regulator having a hairspring rod or a hairspring receive brought into contact with the hairspring at a vicinity of the outer side end portion in the radius direction. The balance with hairspring is reciprocally pivoted centering on the balance stem grossly at a period rectified by the effective length of the hairspring under control of an escapement including an escape wheel & pinion and a pallet fork. There is also well known a structure enabling to roughly adjust and finely adjust a position in a peripheral direction at which the hairspring rod or the hairspring receive is brought into contact with the hairspring (for example, JP-A-48-19262). Further, it is also known that a magnitude of an oscillating angle (rotating angle) of the balance wheel effects an influence on the period of reciprocally pivoting the balance with hairspring and effects an influence on a rate of a timepiece.

Various kinds of improvements have been carried out over many years in order to optimize structures and shapes of respective portions constituting a speed control mechanism and minimize friction or the like of relatively moving portions to minimize loss in reciprocally pi voting a balance with hairspring. The improvements include forming a hairspring by a ferromagnetic material to make a temperature coefficient of Young's modulus positive in order to cancel a thermal expansion of the hairspring by a temperature change of Young's modulus to minimize a temperature dependency in a reciprocally pivoting period of the balance with hairspring.

On the other hand, a frequency adjusting structure of a regulator structure and a regulator fine adjustment structure is seen immediately in removing a case back of a timepiece and therefore, in a background art, the frequency adjusting structure is formed by a material whose major component is iron such as carbon steel in order to meet various requests of clearly polishing a structure in consideration of an outlook thereof, to make the structure as thin as possible to minimize an increase in a thickness of a movement and necessitating a strength for a material to be able to adjust a pivoting position only when a large force is operated thereto. The material is a (ferro) magnetic material.

Further, also with regard to a frequency settling structure such as a stud support, there is a case in which the structure is formed by a material whose major component is iron such as carbon steel by reason similar to that of the frequency adjusting structure and the material is a (ferro)magnetic material.

On the other hand, according to JP-B-44-15925, an escape wheel is covered by a large portion of a plate-like extended portion provided at a pallet fork bridge. A material having a high permeability is used for the pallet fork bridge. Thereby, although the escape wheel cannot be moved by 55 oersted in an ordinary constitution, the escape wheel can be moved up to about 80 oersted.

The inventors have noticed that there is a possibility that a magnetic field effects an influence on a reciprocating characteristic of a balance with hairspring when the inventors have analyzed a characteristic of oscillation of the balance with hairspring, and when the inventors have carried out a test, to the inventor's surprise, the inventors have found that magnetization of a regulator structure effects an influence which is difficult to be disregarded on an oscillating angle of the balance with hairspring (experimentally confirmed).

The invention has been carried out in view of the above-described point and it is an object thereof to provide a speed control mechanism capable of minimizing a reduction in an oscillating angle of a balance with hairspring and a mechanical timepiece having the same.

SUMMARY OF THE INVENTION

A speed control mechanism of the invention includes a frequency setting mechanism having a stud attaching structure and a frequency adjusting mechanism having a regulator structure, wherein at least either one of the stud attaching structure and the regulator structure comprises a nonmagnetic material.

The frequency setting mechanism of the invention includes a balance with hairspring, a stud and a stud support structure (also referred to as stud support). The balance with hairspring is constituted by a structure including a balance stem, a balance wheel, an oscillating seat, a hairspring bead and a hairspring. Further, the frequency adjusting mechanism is constituted by a structure comprising only a regulator structure (also referred to as regulator), or the regulator structure and a regulator finely moving structure. The regulator structure is constituted by a structure including a regulator member, a hairspring receive, and a hairspring rod. The regulator finely moving mechanism is constituted by a structure including a finely moving lever and a regulator tail portion.

The speed control mechanism of the invention comprises a nonmagnetic material and therefore, there is not a concern of magnetizing the speed control mechanism or a portion of the speed control mechanism. Therefore, according to the speed control mechanism of the invention, when integrated to the speed control mechanism, there is not a concern of a reduction in an oscillating angle of the balance with hairspring caused by magnetizing the regulator structure and therefore, the oscillating angle of reciprocally pivoting the balance with hairspring can maximally be maintained. As a result, a concern that operation of the speed control mechanism is influenced by an attitude of an apparatus integrated with the speed control mechanism including the regulator structure (typically, a timepiece) or an outer environment is reduced.

It seems that the oscillating angle of the balance with hairspring is reduced when the speed control mechanism comprises a magnetic material and the speed control mechanism is magnetized because of the following reason. That is, when the speed control mechanism comprising a magnetic material is magnetized under an influence of an outside magnetic field, an eddy current is generated at the balance wheel when the balance wheel comprising a metal material is reciprocally pivoted under a nonuniform magnetic field generated by residual magnetization of the speed control mechanism, a brake force against reciprocal pivoting of the balance wheel is produced and therefore, the oscillating angle of the balance with hairspring is reduced. However, the interpretation with regard to the cause shows one way of view at a current time point, the invention is constituted by formation per se of forming the regulator structure by a nonmagnetic material in order to avoid a reduction (decrease) of the oscillating angle and is not limited to whether the main cause of the reduction in the oscillating angle is derived from generation of the eddy current.

As a nonmagnetic material, for example, there is used austenitic (for example, 18Ni-8Cr species) stainless steel (for example, SUS304, SUS316 species or the like), titanium or an alloy thereof (for example, Ti-6Al-4V) or the like. However, any other nonmagnetic material will do so far as the material meets requests of a mechanical strength, polishability and the like. For example, the nonmagnetic material may be other kind of metal or alloy as in a copper alloy such as brass.

A speed control mechanism of the invention achieving the above-described object includes a regulator including a regulator member, hairspring receive and a hairspring rod, a regulator tail portion and a finely moving lever and the regulator and regulator tail portion comprise a nonmagnetic material. Although it is preferable that also the finely moving lever for finely adjusting a position of the regulator by way of the regulator tail portion comprises a nonmagnetic material, the finely moving lever is relatively provided with a comparatively small volume and a distance between the finely moving lever and the balance wheel is long and therefore, depending on cases, the finely moving lever may comprise a magnetic material. Further, although it is preferable that the magnetic material is a soft magnetic material such that even when the material is temporarily magnetized, residual magnetization is inconsiderable, an influence thereof is comparatively inconsiderable as described above and therefore, the material may be a hard magnetic material such as carbon steel.

When the invention is described from a view point of a speed control mechanism, in order to achieve the above-described object, a speed control mechanism of the invention includes a frequency setting mechanism having a stud attaching structure and a frequency adjusting mechanism having a regulator structure and a regulator finely adjusting structure, wherein at least any one the stud attaching structure, the regulator structure and the regulator finely adjusting structure comprises a nonmagnetic material.

According to the speed control mechanism of the invention, the speed control mechanism comprises a nonmagnetic material and therefore, there is not a concern of magnetizing the speed control mechanism or a portion of the speed control mechanism and therefore, even when the timepiece is thinned, there is not a concern of reducing the oscillating angle of reciprocally pivoting the balance wheel by a magnetic field caused by magnetizing the speed control mechanism. That is, when the speed control mechanism comprises a magnetic material, it is necessary to shorten a distance between the regulator structure and the balance wheel in accordance with thin formation of the timepiece, a nonuniform magnetic field generated by the regulator structure at a region of reciprocally pivoting the balance wheel is intensified and there is a higher concern of reducing the oscillating angle of the balance wheel, however, according to the speed control mechanism of the invention, such a problem can be avoided from being brought about.

In the speed control mechanism of the invention, typically, the balance with hairspring comprises a nonmagnetic conductive material, the stud structure comprises a nonmagnetic material, and the hairspring comprises a magnetic material.

The balance wheel of the balance with hairspring typically comprises a nonmagnetic metal material such as brass. Further, the balance stem comprises a magnetic metal material such as carbon steel. However, when desired, the material may not be a metal. The stud structure typically includes a stud support, a stud and a hairspring setscrew respectively made of a nonmagnetic material.

On the other hand, the hairspring is formed by a magnetic material, that is, a ferromagnetic material in order to minimize a temperature dependency of a characteristic of oscillating the hairspring by utilizing ΔE effect for making a temperature coefficient of Young's modulus positive.

A mechanical timepiece of the invention includes the above-described speed control mechanism.

BRIEF DESCRIPTION OF THE DRAWINGS

A preferred form of the present invention is illustrated in the accompanying drawings in which:

FIG. 5 show experimental results of an influence of a magnetic field for various samples, where FIG. 5A is a diagram showing a list of a kind of a sample used in the experiment, and FIG. 5B is a diagram showing an amount of changing an oscillating angle (difference between the oscillating angle and the oscillating angle before being exposed to a magnetic field) after taking out the various samples from the magnetic field.

DETAILED DESCRIPTION OF THE PREFERRED EMBODIMENTS

Next, an explanation will be given of a preferable embodiment of the invention based on a preferable embodiment shown in the attached drawings as follows.

Figure 1:
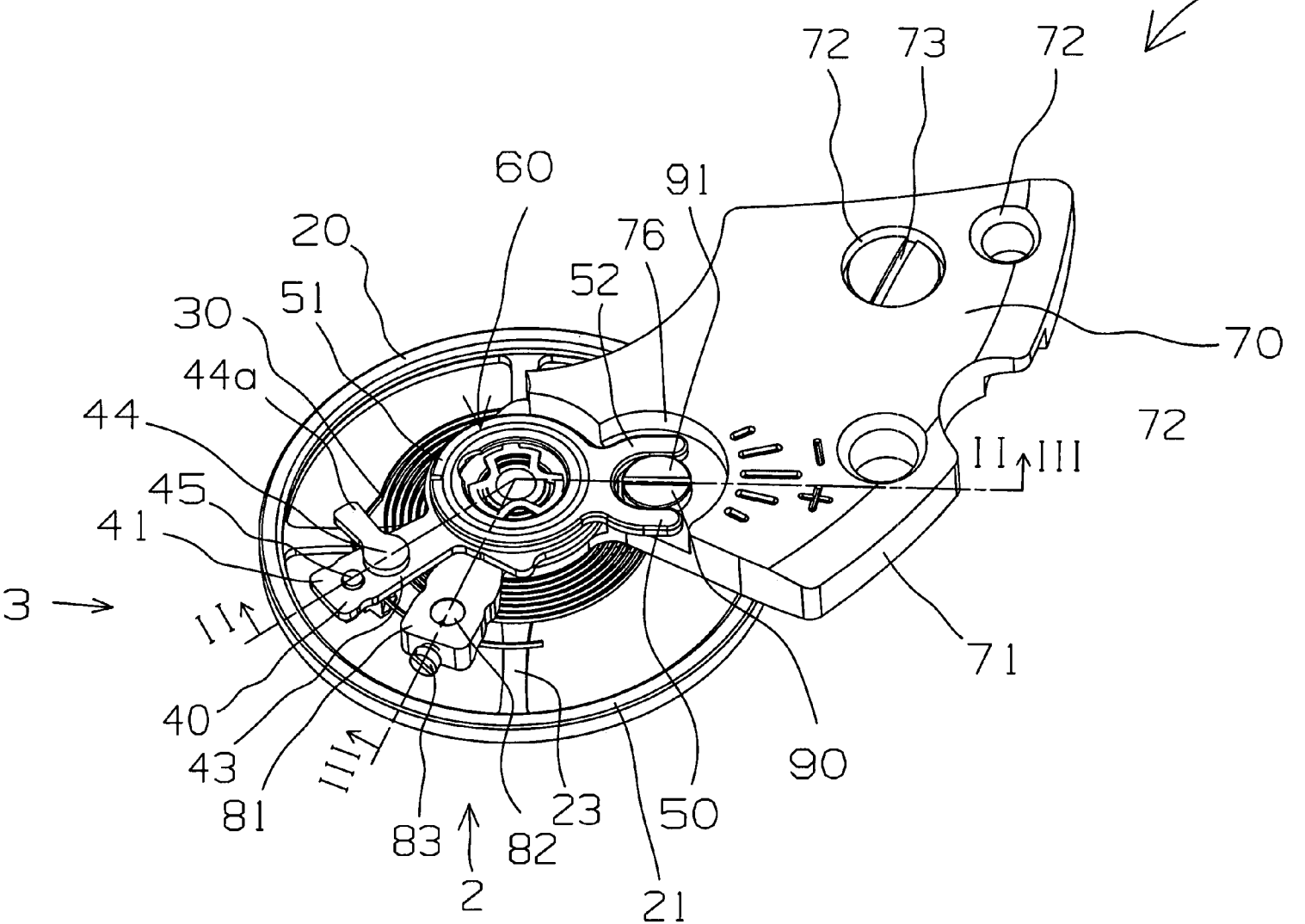
FIG. 1 is a perspective explanatory view of a speed control mechanism according to a preferable embodiment of the invention.
Figure 2:
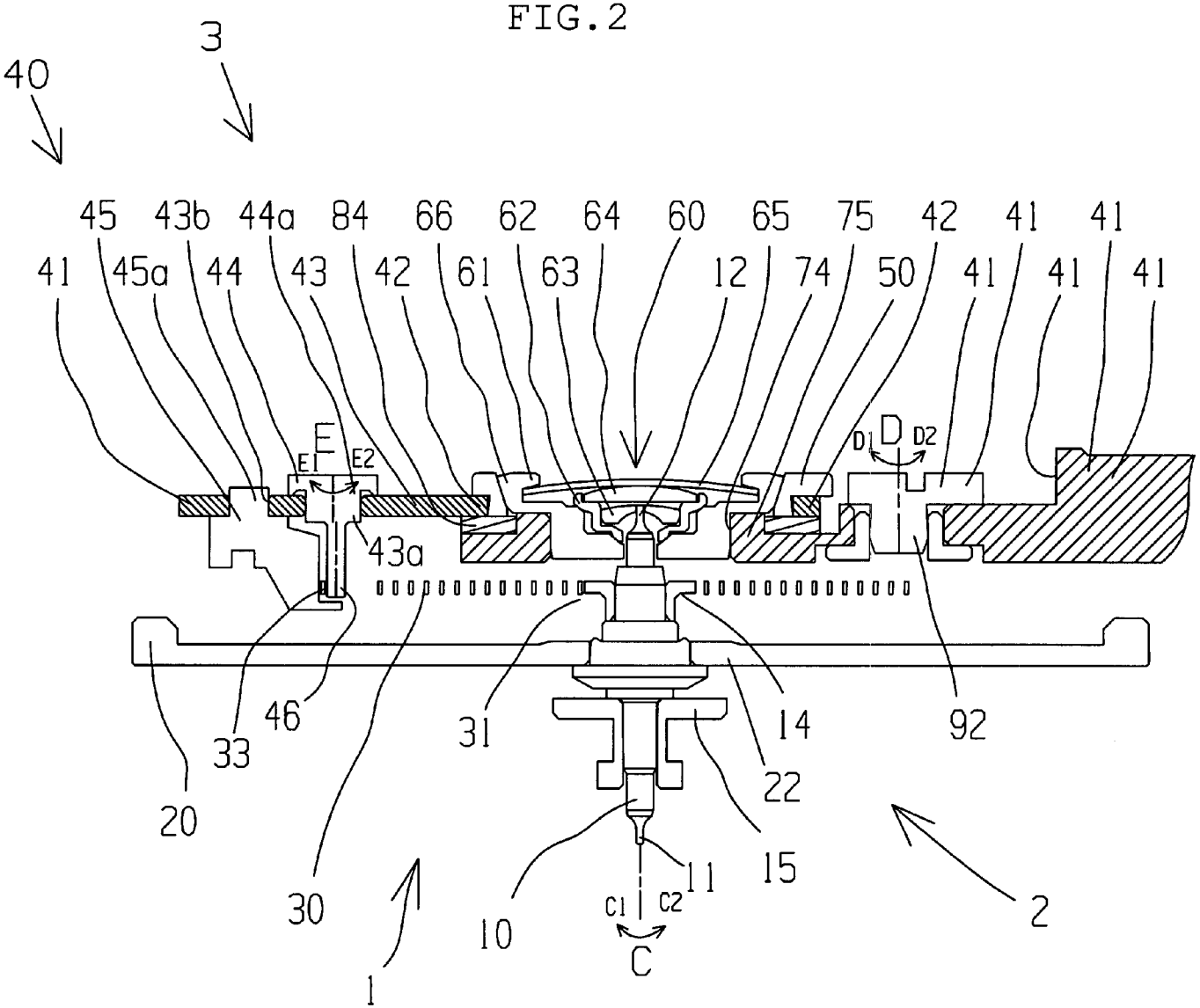
FIG. 2 is an explanatory view of a section taken along a line II-II of the speed control mechanism of FIG. 1.
Figure 3:
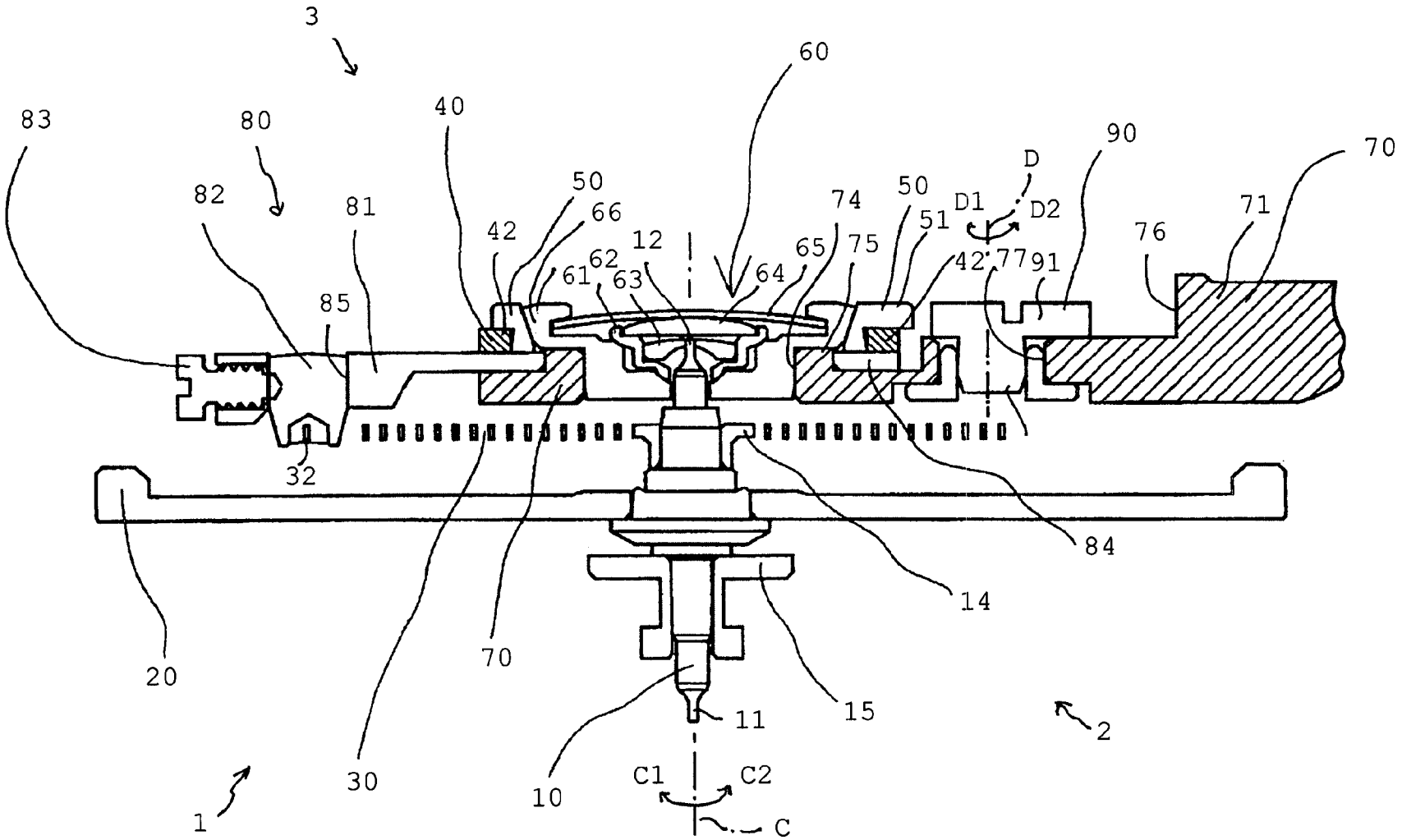
FIG. 3 is an explanatory view of a section taken along a line III-III of the speed control mechanism of FIG. 1.

As shown by FIG. 1 through FIG. 3, a speed control mechanism 1 of a preferable embodiment of the invention includes a balance with hairspring 2 and an upper bearing 60 and a lower bearing (not illustrated) thereof, a hairspring 30, a stud structure 80, and a regulator structure 3. The balance with hairspring 2 is rotatable in C1, C2 directions around a center axis line C and includes a balance stem 10 and a balance wheel 20.

According to the balance stem 10, one end 11 thereof is rotatably supported by a balance lower bearing (not illustrated) mounted to a main plate (not illustrated), and other end portion 12 is rotatably supported by the balance upper bearing 60 in a mode of an aseismatic bearing. Therefore, the balance stem 10 is rotatable in C1, C2 directions around the center axis line C relative to the main plate (not illustrated). The balance upper bearing 60 is fittingly attached to a balance bridge 70 at a balance upper outer frame 61, and includes a balance upper movable hole jewel frame 62, a balance upper hole jewel 63, a balance upper receive jewel 64 and a balance upper receive jewel holding spring 65 in this example.

The balance bridge 70 comprises a thick wall shape member 71 made of a nonmagnetic material such as brass, and positioned and fixed to the main plate 2 by a setscrew 73 fitted to an opening 72 and a positioning guide leg portion (not illustrated). The balance bridge 70 further includes a hole 74 to which the upper outer frame 61 of the balance upper bearing 60 is fitted and a projected peripheral wall portion 75 thereof as well as a recess portion 76 and a hole 77 arranged with a finely moving lever, mentioned later.

The balance wheel 20 made of brass integrally includes a rim portion 21 in a circular shape, and a plurality of arm portions 23 extended in a radius direction between the rim portion 21 and a center boss portion 22, and is fittingly attached to the balance stem 10 at the boss portion 22.

The balance stem 10 is further mounted with a hairspring bead 14, and the hairspring bead 14 is fixed with a radius direction inner side end portion 31 of the hairspring 30 comprising a magnetic material. An oscillating seat 15 comprising a nonmagnetic material such as brass is provided with an oscillating jewel (not illustrated) and is engaged with an escapement (pallet fork and escape wheel & pinion) (not illustrated).

An outer side end portion 32 of a spiral of the hairspring 30 is attached to a stud structure 80 comprising a nonmagnetic material such as brass by adhering, calking or the like. The stud structure 80 includes a stud bridge 81, a stud 82, and a stud setscrew 83. The stud bridge 81 includes a ring-like base end portion 84 fitted to an outer periphery of the projected peripheral wall portion 75 of the balance bridge 70, and a front end side hole portion 85 for receiving to incorporate the stud 82. The stud 82 locking the outer side end portion 32 of the hairspring 30 is fitted to the hole portion 85 of the stud bridge 81 and is fixed to the stud bridge 81 by the setscrew 83.

In the illustrated example, a frequency adjusting mechanism 3 is constituted by a regulator 40 constituting a main body of the mechanism 3, a regulator tail portion 50, and a finely moving lever 90. The regulator 40 and the regulator tail portion 50 also comprise a nonmagnetic material such as brass. The nonmagnetic material may be austenitic (for example, 18Ni-8Cr species) stainless steel (for example, SUS304, SUS316 or the like), titanium or an alloy thereof (for example, Ti-6Al-4V) or the like in place of brass.

The regulator tail portion 50 is fitted above of the ring-like base end portion 84 of the stud bridge 81 and at an outer periphery of a truncated cone shape large diameter portion 66 of upper outer frame 61 of the balance upper bearing 60 to be relatively pivotably in C1, C2 directions by a ring-like portion 51 having a section substantially in an L-like shape. The regulator tail portion 50 is provided with a tail portion main body portion 52 in a U-like shape extended from the ring-like portion 51 in a radius direction and the U-like tail portion main body portion 52 is engaged with a circular disk shape head portion 91 of the finely moving lever 90.

The finely moving lever 90 is provided with a shaft portion 92 fitted to the hole 77 of the balance bridge 70 in D1, D2 directions around a center axis line D, and the head portion 91 is eccentric to the shaft portion 92. Therefore, when the eccentric head portion 91 of the finely moving lever 90 is pivoted in D1, D2 directions around the center axis line D, the tail portion main body portion 52 is pivoted in C1, C2 directions (or conversely in C1, C2 directions) around the center axis line C by a small amount. Also the finely moving lever 90 preferably comprises a nonmagnetic material such as brass. However, depending on cases, the finely moving lever 90 may comprise a magnetic material.

A regulator member 41 of the regulator 40 is fitted to above the ring-like base end portion 84 of the stud bridge 81 and an outer periphery of the ring-like portion 51 having the section in the L-like shape of the regulator tail portion 50 relatively pivotably in C1, C2 directions by a ring-like base end portion 42. Therefore, when the regulator tail portion 50 is pivoted in C1, C2 directions by rotating the finely moving lever 90, also the regulator 40 including the regulator member 41 is pivoted integrally with the tail portion 50 in C1, C2 directions.

The regulator member 41 is provided with an arm portion 43 extended from the ring-like portion 42 in a radius direction, a hole portion 43*a* of a middle portion of the arm portion 43 is fittingly attached with a hairspring rod 44 by a base end large diameter portion 44*a*, and a hole portion 43*b* on a front end side is fittingly attached with a hairspring receive 45 by a base end small diameter portion 45*a*. The hairspring rod 44 is provided with a hairspring rod main body 46 having an axis line E extended in parallel with the axis line C and eccentric to the hole portion 43*a* of the regulator member. When the hairspring rod arm portion 44*a* is pivoted in e1, e2 directions, the hairspring rod main body 46 is pivoted to make a distance between the hairspring rod main body 46 and the hairspring receive 45 variable. In a free stationary state of the balance with hairspring 2, one portion 33 of an outer peripheral side portion of the hairspring 30 can be adjusted to a position at which the portion is not brought into contact with the hairspring rod main body 46 and the hairspring receive 45, or can be adjusted to be brought into contact with the hairspring rod main body 46, or the hairspring receive 45. Further, in accordance with a rotating angle (oscillating angle) of the balance with hairspring 2, the hairspring rod main body 46 or the hairspring receive 45 and the hairspring can also be adjusted to switch contact and noncontact states.

Therefore, when the regulator tail portion 50 is pivoted in C1, C2 directions by rotating the finely moving lever 90 and the regulator 40 is pivoted in C1, C2 directions, also the hairspring rod 44 and the hairspring receive 45 are pivoted in C1, C2 directions, a position of the contact end portion 33 of the hairspring 30 is changed in C1, C2 directions, by changing the effective length of the hairspring 30, a period of reciprocally pivoting the balance with hairspring 2 is changed and the speed control mechanism 1 controls the speed.

The larger the oscillating angle of the balance with hairspring 2, the more stable the operation of the above-described speed control mechanism 1 and when the oscillating angle is reduced, the operation of reciprocating the balance with hairspring 2 is liable to be varied by an attitude of a timepiece 5 (FIG. 4) having the speed control mechanism 1, shock (acceleration) received by the timepiece 5 or the like.

Further, according to the mechanical timepiece 5, further strictly, the period of reciprocally pivoting the balance with hairspring 2 restricted by the escapement (not illustrated) is slightly changed and the "rate" (an amount (second/day) by which the timepiece 5 gains or loses per day when a state and an environment of the oscillating angle in measuring the rate are maintained) is changed depending not only on a torque (wound up state) of the mainspring but also on the "oscillating angle" of the balance with hairspring 2. Therefore, there is also a concern that the rate is varied by varying the oscillating angle.

<Test>

It is experimentally investigated how the oscillating angle of the balance with hairspring 2 is changed when a magnetic material is used in place of a nonmagnetic material for the regulator member 41, the regulator tail portion 50 and the finely moving lever 90 of the regulator 40 constituting the regulator structure 3 with regard to the speed control mechanism 1 shown in the above-described embodiment.

<Sample>

Figure 4:
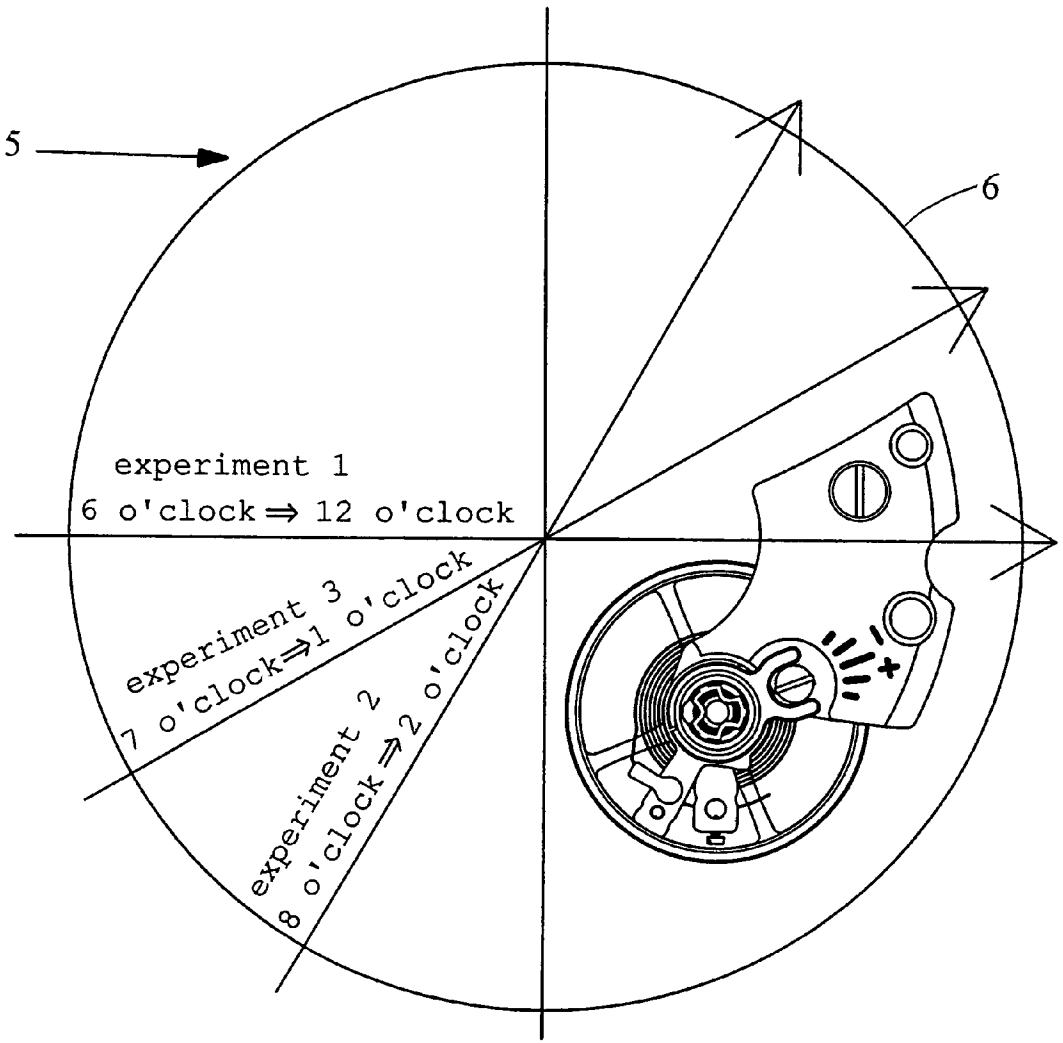
FIG. 4 is a plane explanatory view showing an experimental condition of being exposed to an outside magnetic field.

An experiment of investigating an influence effected on a speed control mechanism by magnetization by preparing the timepiece 5 integrated with various samples shown in FIG. 5A. In the experiment, 3 pieces of samples are prepared respectively for each sample. Further, as shown by FIG. 4, in a state of being integrated to the timepiece 5, the regulator 40 is extended in parallel with a direction precisely connecting 8 o'clock and 2 o'clock in a case 6 of the timepiece 5. FIG. 4 shows a state viewing a portion of the speed control mechanism 1 of the timepiece 5 from a side of a back case.

Sample 5 comprises brass constituting a nonmagnetic material for all of the regulator member 41, the regulator tail portion 50 and the finely moving lever 90 in addition to the stud bridge 81 and the stud 82, sample 4 comprises carbon steel which is a ferromagnetic material in place of brass only for the finely moving lever 90, and sample 2 or sample 3 comprises carbon steel which visa ferromagnetic material in place of brass for the regulator tail portion 50 or the regulator member 41 other than the finely moving lever 90. On the other hand, sample 1 is of a type used in the background art and comprises carbon steel which is a ferromagnetic material for all of the regulator structure 2 comprising the regulator member 41, the regulator tail portion 50 and the finely moving lever 90. Here, sample 5 and sample 4 correspond to the embodiment and samples 1 through 3 are comparative examples. Further, sample 1 is the background art.

In the above-described, the hairspring rod 44 and the hairspring receive 45 of the regulator 40 are made of brass in any of the cases and therefore, when the regulator member 41 is made of brass (sample 5, sample 4 and sample 2), a total of the regulator 40 is made of brass.

<Test condition>

(1) Each sample previously demagnetized and winding up the hairspring in a fully wound up state is mounted on a test base in an attitude of directing a dial upward, left under a magnetic field of 1600 A/m (200 (Oe)) after gradually strengthen the outer magnetic field and taken out from the magnetic field of at a time point of elapse of one minute.

(2) According to experiments 1 through 3, directions of applied magnetic fields differ respectively as shown by FIG. 4. In experiment 1, the magnetic field is applied in a direction directed from 6 o'clock to 12 o'clock of the timepiece, in experiment 2, the magnetic field is applied in a direction directed from 8 o'clock to 2 o'clock of the timepiece, and in experiment 3, the magnetic field is applied in a direction directed from 7 o'clock to 1 o'clock of the timepiece.

<Measurement>

(1) Before applying the magnetic field, the "oscillating angle" is measured for each sample. The oscillating angle is measured by Watch Expert II made by Witschi corporation.

(2) The "oscillating angle" is measured similarly also for each sample taken out from the magnetic field.

<Experimental Result of Oscillating Angle>

An amount of a change in the "oscillating angle" is calculated from the "oscillating angle" before applying the magnetic field ((1) of <Measurement>) and the "oscillating angle" after having been exposed in the magnetic field ((2) of <Measurement>). The result is as shown by FIG. 5B. Further, each numerical result is an average value of a result provided by 3 pieces of samples.

<Evaluation of Experimental Result>

(1) As shown by FIG. 5B, when at least either of the regulator member 41 and the regulator tail portion 50 comprises carbon steel (magnetic material), as is known from results of samples 1 through 3, the oscillating angle of the balance with hairspring after having been taken out to outside of the magnetic field is considerably reduced. This shows that the regulator member 41 and the regulator tail portion 50 magnetized by being arranged in the magnetic field is operated as a resistance for hampering reciprocal pivoting of the balance with hairspring 2. Although there is more or less direction dependency of the magnetic field, the dependency is not so significant.

(2) When the oscillating angle is considerably reduced in this way, there is a concern of deteriorating a stability of operation of the balance with hairspring 2 by the attitude of the timepiece 5 and a shock or the like received by the timepiece 5. Further, depending on cases, there is also a concern of changing the rate.

(3) It seems that the resistance against the reciprocal pivoting of the balance with hairspring 2 is caused by eddy current produced in the balance wheel 20 reciprocally pivoted in C1, C2 directions under the magnetic field generated by residual magnetization of the regulator member 41 or the regulator tail portion 50.

That is, as is known from FIG. 1 and FIG. 3, according to the speed control mechanism 1, the balance wheel 20 comprising a conductive material (brass) is reciprocally pivoted in C1, C2 directions at a location at which the balance wheel 20 is proximate to the regulator structure 40 which is slender as a whole and therefore, when the essential portion 41 or 50 of the regulator structure 40 is assumedly magnetized, the magnetization generates a nonuniform magnetic field at a region at which the balance wheel 20 is reciprocally pivoted, and the balance wheel 20 is reciprocally pivoted in the magnetic field. Therefore, an eddy current is generated in the balance wheel 20 and the eddy current exerts a brake force to the reciprocal pivoting of the balance wheel 20 under the magnetic field. However, the invention is not limited by the interpretation.

(4) On the other hand, as is known by FIG. 5B, with regard to sample 5 in which all the portions 40, 50, 90 of the regulator structure 3 comprise the nonmagnetic material (brass), the oscillating angle is hardly changed. Further, in the case of sample 4 in which only the finely moving lever 90 comprises the magnetic material (carbon steel) and the other portions comprise the nonmagnetic material (brass), although there is a slight influence of the magnetic field, the influence is comparatively small. Therefore, it is known that it is preferable to form a total of the regulator structure 3 by the nonmagnetic material in order to maintain the oscillating angle of the balance with hairspring 2 of the speed control mechanism 1 to be large and maintaining the speed control mechanism 1 stably against an outside disturbance. However, the finely moving lever 90 may be constituted by the magnetic material.

(5) When the speed control mechanism 1 is thinned with an object of thin formation of the timepiece 5 or the like, a distance between the regulator member 41 or the regulator tail portion 50 and the balance wheel 20 is necessarily reduced and therefore, the magnetic field which is produced by the regulator 41 or the regulator tail portion 50 at a location of the balance wheel 20 is increased and there is a concern that the above-described influence becomes more significant. Therefore, it seems that the significance of forming a substantial portion of the total of the regulator structure 3 by the nonmagnetic material is considerable.

(6) Further, in the above-described, for example, even in the case (sample 5) in which the total of the regulator structure 3 is formed by the nonmagnetic material, since the hairspring 30 is produced by a magnetic material, for example, there is a possibility that the residual magnetization of the hairspring 30 effects an influence on contracting and enlarging operation of the spiral of the hairspring 30 related to the reciprocal pivoting of the balance with hairspring 2 and effects an influence on a change in the oscillating angle of the balance with the hairspring 2.

What is claimed is:

1. A speed control mechanism comprising:

a frequency setting mechanism having a stud attaching structure; and a frequency adjusting mechanism having a regulator structure formed of a nonmagnetic material.

2. A speed control mechanism comprising:

a frequency setting mechanism having a stud attaching structure; and a frequency adjusting mechanism having a regulator structure and a regulator fine adjustment structure both formed of a nonmagnetic material.

3. A mechanical timepiece having the speed control mechanism according to claim 1.

4. A mechanical timepiece having the speed control mechanism according to claim 2.

5. A speed control mechanism according to claim 1; wherein the stud attaching structure of the frequency setting mechanism is formed of a nonmagnetic material.

6. A speed control mechanism according to claim 5; wherein the frequency setting mechanism has a hairspring formed of a magnetic material.

7. A speed control mechanism according to claim 1; wherein the frequency setting mechanism has a hairspring formed of a magnetic material.

8. A speed control mechanism according to claim 2; wherein the stud attaching structure of the frequency setting mechanism is formed of a nonmagnetic material.

9. A speed control mechanism according to claim 8; wherein the frequency setting mechanism has a hairspring formed of a magnetic material.

10. A speed control mechanism according to claim 2; wherein the frequency setting mechanism has a hairspring formed of a magnetic material.

11. A speed control mechanism comprising:

a balance with hairspring mounted to undergo oscillation movement; and a regulator structure for adjusting a position of the balance with hairspring, the regulator structure being formed of a nonmagnetic material to prevent reduction of an oscillation angle of the balance with hairspring during oscillation movement thereof.

12. A speed control mechanism according to claim 11; wherein the balance with hairspring forms part of a frequency setting mechanism having a stud attaching structure made of a nonmagnetic material.

13. A speed control mechanism according to claim 12; wherein the regulator structure forms part of a frequency adjusting mechanism having a regulator fine adjustment structure made of a nonmagnetic material.

14. A speed control mechanism according to claim 13; wherein the regulator structure forms part of a frequency adjusting mechanism having a regulator tail portion made of a nonmagnetic material.

15. A speed control mechanism according to claim 11; wherein the regulator structure forms part of a frequency adjusting mechanism having a regulator fine adjustment structure and a regulator tail portion both made of a nonmagnetic material.

16. A speed control mechanism according to claim 11; wherein the balance with hairspring forms part of a frequency setting mechanism having a hairspring formed of a magnetic material.

17. A speed control mechanism according to claim 11; wherein the nonmagnetic material is selected from the group consisting of austenitic stainless steel, titanium, a titanium alloy, and a copper alloy.

18. A mechanical timepiece having the speed control mechanism according to claim 11.

* * * * *